US009670801B2

(12) United States Patent
Hwang et al.

(10) Patent No.: US 9,670,801 B2
(45) Date of Patent: Jun. 6, 2017

(54) CYLINDER DEACTIVATION ENGINE

(71) Applicant: HYUNDAI MOTOR COMPANY, Seoul (KR)

(72) Inventors: Gyu Han Hwang, Yongin-si (KR); Hyeon Cheol Joo, Goyang-si (KR); Joon Suk Lee, Gyeonggi-do (KR)

(73) Assignee: HYUNDAI MOTOR COMPANY, Seoul (KR)

( * ) Notice: Subject to any disclaimer, the term of this patent is extended or adjusted under 35 U.S.C. 154(b) by 0 days.

(21) Appl. No.: 14/861,226

(22) Filed: Sep. 22, 2015

(65) Prior Publication Data

US 2016/0363013 A1 Dec. 15, 2016

(30) Foreign Application Priority Data

Jun. 12, 2015 (KR) ..... 10-2015-0083555

(51) Int. Cl.

| | |
|---|---|
| ***F01L 13/00*** | (2006.01) |
| ***F02D 17/02*** | (2006.01) |
| ***F01L 1/18*** | (2006.01) |
| *F02D 41/00* | (2006.01) |
| *F02D 13/06* | (2006.01) |

(52) U.S. Cl.

CPC ..... *F01L 13/0005* (2013.01); *F01L 1/185* (2013.01); *F02D 17/02* (2013.01); *F01L 2001/186* (2013.01); *F01L 2013/001* (2013.01); *F02D 13/06* (2013.01); *F02D 2041/0012* (2013.01)

(58) Field of Classification Search

CPC ..... F01L 13/00; F01L 13/0005; F01L 13/06; F01L 2013/001; F02D 2041/0012; F02D 13/06

USPC ..... 123/321

See application file for complete search history.

(56) References Cited

U.S. PATENT DOCUMENTS

| | | | | |
|---|---|---|---|---|
| 8,539,920 | B2 * | 9/2013 | Meldolesi | F01L 1/185 123/90.16 |
| 8,893,675 | B2 * | 11/2014 | Sugiura | F01L 1/34 123/90.16 |
| 9,399,932 | B2 * | 7/2016 | Kwak | F01L 1/047 |

(Continued)

FOREIGN PATENT DOCUMENTS

| | | |
|---|---|---|
| JP | 5272653 | 8/2013 |
| KR | 10-1231414 B1 | 2/2013 |

(Continued)

*Primary Examiner* — Sizo Vilakazi
*Assistant Examiner* — Kevin R Steckbauer
(74) *Attorney, Agent, or Firm* — Brinks Gilson & Lione

(57) ABSTRACT

The present disclosure provides a cylinder deactivation engine which is configured to prevent abrasion on a pad portion of a valve opening/closing unit and improves reliability of the cylinder deactivation. The cylinder deactivation engine selectively performing deactivation of a cylinder may include: a cylinder deactivation apparatus including an inner body which contacts with a cam formed at a camshaft and makes a lever motion by rotation of the camshaft; and an outer body which moves together with the inner body by selectively latching to the inner body so as to open/close a valve; and a stopper integrally formed with a cam carrier disposed to surround a part of a lower portion of the camshaft and disposed between the camshaft and the outer body so as to function as a stopper for blocking the outer body which is pushed toward the camshaft by the valve.

6 Claims, 3 Drawing Sheets

(56) References Cited

U.S. PATENT DOCUMENTS

| | | | | |
|---|---|---|---|---|
| 2010/0180847 | A1* | 7/2010 | Meldolesi | F01L 1/185<br>123/90.45 |
| 2015/0114330 | A1* | 4/2015 | Kwak | F01L 1/047<br>123/90.16 |
| 2016/0160696 | A1* | 6/2016 | Hwang | F01L 13/0005<br>123/90.16 |

FOREIGN PATENT DOCUMENTS

| | | | | |
|---|---|---|---|---|
| KR | 10-1368566 | B1 | 2/2014 | |
| KR | 101368566 | B1 * | 2/2014 | F01L 13/00 |

* cited by examiner

CYLINDER DEACTIVATION ENGINE

CROSS-REFERENCE TO RELATED APPLICATION

This application claims the benefit of Korean Patent Application No. 10-2015-0083555, filed on Jun. 12, 2015, which is hereby incorporated by reference in its entirety.

FIELD

The present disclosure relates to a cylinder deactivation engine.

BACKGROUND

The statements in this section merely provide background information related to the present disclosure and may not constitute prior art.

Generally, an internal combustion engine is an apparatus that operates using energy from heat generated by burning a gas mixture in a combustion chamber. As an internal combustion engine, a multi-cylinder engine with a plurality of cylinders for increasing power and reducing noise and vibration is generally used.

Recently, a cylinder deactivation apparatus of an engine that improves fuel efficiency by deactivating some of a plurality of cylinders in an engine when the engine generates a small amount of power has been developed with the increase in energy cost.

A way of deactivating cylinders used by such a cylinder deactivation apparatus is to operate an engine by injecting and burning a gas mixture in only some of the plurality of cylinders without injecting and igniting a gas mixture in the other cylinders.

For example, for a four-cylinder engine, the apparatus does not inject and ignite a gas mixture in two cylinders and operates the engine with only the other two cylinders.

Meanwhile, a variable valve lift technique that selectively implements a zero lift of a valve so that a gas mixture is not injected may be applied to deactivated cylinders.

However, abrasion of the pad portion may be occurred when a pad portion of a valve opening/closing unit is in rolling-contact with a zero cam or a camshaft to realize zero lift of a valve. Durability of the valve opening/closing unit may be deteriorated if the pad portion of the valve opening/closing unit is worn. In addition, if the pad portion is worn, reliability about cylinder deactivation may be deteriorated as the valve opening/closing unit makes a lever motion depending on rotation of a cam even while the valve opening/closing unit is operated so as to realize the zero lift of the valve.

SUMMARY

The present disclosure provides a cylinder deactivation engine having advantages of reducing or preventing abrasion on a pad portion of a valve opening/closing unit and providing reliability about the cylinder deactivation.

A cylinder deactivation engine according to an exemplary embodiment of the present disclosure which selectively perform deactivation of a cylinder may include: a cylinder deactivation apparatus including an inner body which contacts with a cam formed at a camshaft and makes a lever motion by rotation of the camshaft, and an outer body which moves together with the inner body by selectively latching to the inner body so as to open/close a valve; and a stopper integrally formed with a cam carrier disposed to surround a part of a lower portion of the camshaft and disposed between the camshaft and the outer body so as to function as a protrusion for blocking the outer body which is pushed toward the camshaft by the valve.

The outer body may make a lever motion together with the inner body by latching to the inner body such that normal lift of the valve is performed, and the outer body may do not make a lever motion by releasing from the inner body such that zero lift of the valve is performed.

A part of an upper portion of the outer body to face the camshaft may be contacted to the stopper when zero lift of the valve is performed.

The cam carrier may be disposed apart from the cam by a predetermined distance along an axial direction, and the stopper may be protruded from the cam carrier toward the cam along an axial direction.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

DESCRIPTION OF SYMBOLS

Figure 1:
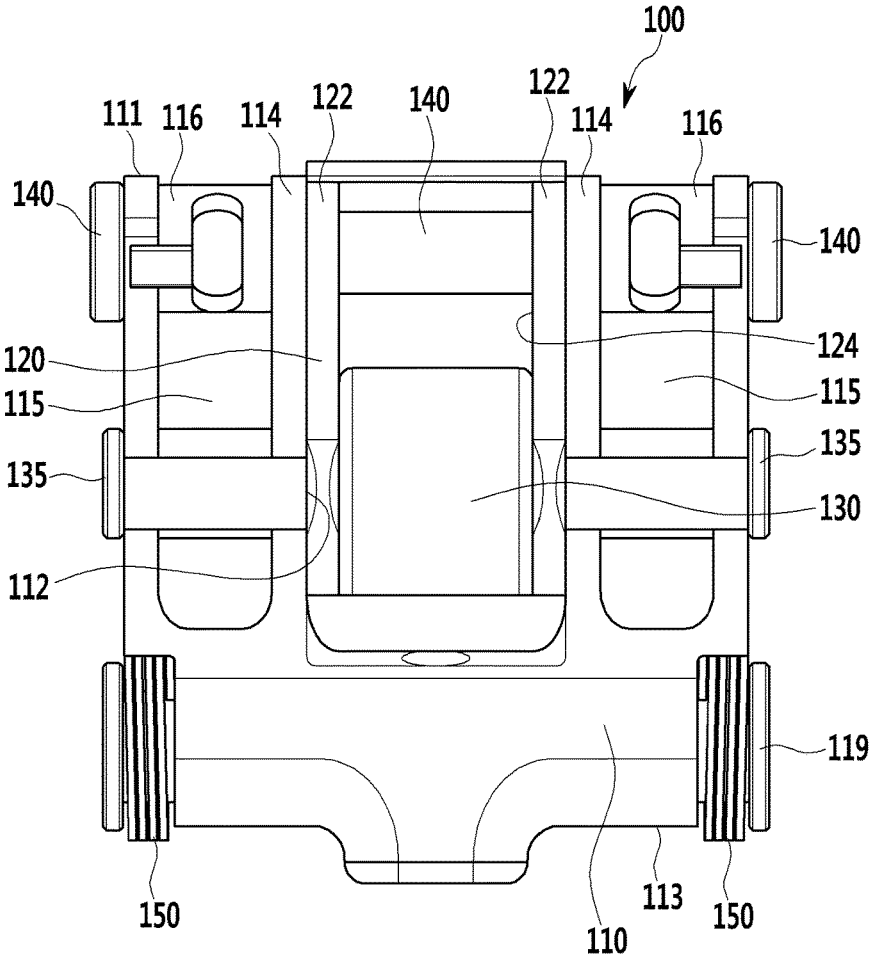
FIG. 1 is a top plan view of a cylinder deactivation apparatus according to an exemplary embodiment of the present disclosure.

| | |
|---|---|
| 100: cylinder deactivation apparatus | 110: outer body |
| 112: outer body inside space | 114: outer connecting portion |
| 115: pad portion | 116: valve contact portion |
| 119: lever motion pivot shaft | |
| 120: inner body | 122: inner connecting portion |
| 124: inner body inside space | 129: latching pin hole |
| 130: roller | 135: roller rotation shaft |
| 140: connecting shaft | |
| 150: lost motion spring | |
| 160: latching pin | 165: latching spring |
| 167: latching pin stopper | 169: hydraulic pressure chamber |
| 200: camshaft | 202: normal cam |
| 204: zero cam | 210: cam cap |
| 220: cam carrier | 225: pad portion stopper |

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

FIG. 1 is a top plan view of a cylinder deactivation apparatus according to an exemplary embodiment of the present disclosure.

As shown in FIG. 1, a cylinder deactivation apparatus 100 according to an exemplary embodiment of the present disclosure includes an outer body 110, an inner body 120, a roller 130, a connecting shaft 140, and a lost motion spring 150. In addition, the cylinder deactivation apparatus 100 is a valve opening/closing unit which is operated so as to selectively realize zero lift of a valve.

The outer body 110 selectively receives torque of a camshaft 200 (FIG. 3) so as to make a lever motion, and operates to open/close the valve by the lever motion. In addition, a normal cam 202 is formed or disposed at the camshaft 200 so as to transform a rotational motion of the camshaft 200 to the lever motion of the outer body 110. Herein, the valve is an intake valve or an exhaust valve of an engine. Further, a space 112, that the outer body 110 is penetrated in a vertical direction, is formed inside of the outer body 110. That is, the outer body 110 has a set length so as to make a lever motion, and has a set width and a set thickness so as to form the inside space 112 of the outer body 110.

The valve is connected to a first end 111 of the outer body 110, and a lever motion pivot shaft 119 is disposed at the other second end 133 thereof, opposite the first end 111. In addition, the inside space 112 of the outer body 110 is opened toward the first end 111 of the outer body 110 such that an entire shape of the outer body 110 is formed in a "U" shape.

In description hereinafter, the first end 111 and the second end 113 of each elements which are connected to or disposed at the outer body 110 mean a portion on the same side with the first end 11 and the second end 113 of the outer body 110.

The inner body 120 is disposed in the inside space 112 of the outer body 110. In addition, one end of the inner body 120 is rotatably connected with the first end 111 of the outer body 110 by connecting shaft 140. Further, the inner body 120 makes a lever motion according to torque of the camshaft 200, and operates to selectively open/close the valve. A space 124 that the inner body 120 is penetrated in a vertical direction is formed inside of the inner body 120. That is, the inner body 120 has a set length so as to make a lever motion, and has a set width and a set thickness so as to form the inside space 124 of the inner body 120.

Figure 2:
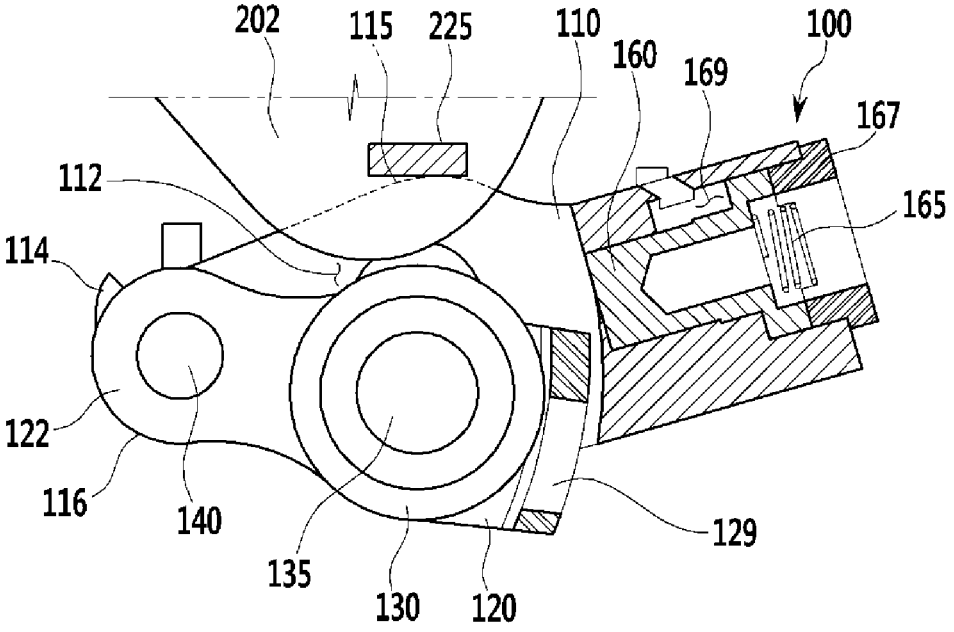
FIG. 2 is a cross sectional side view of a cylinder deactivation apparatus according to an exemplary embodiment of the present disclosure.
Figure 3:
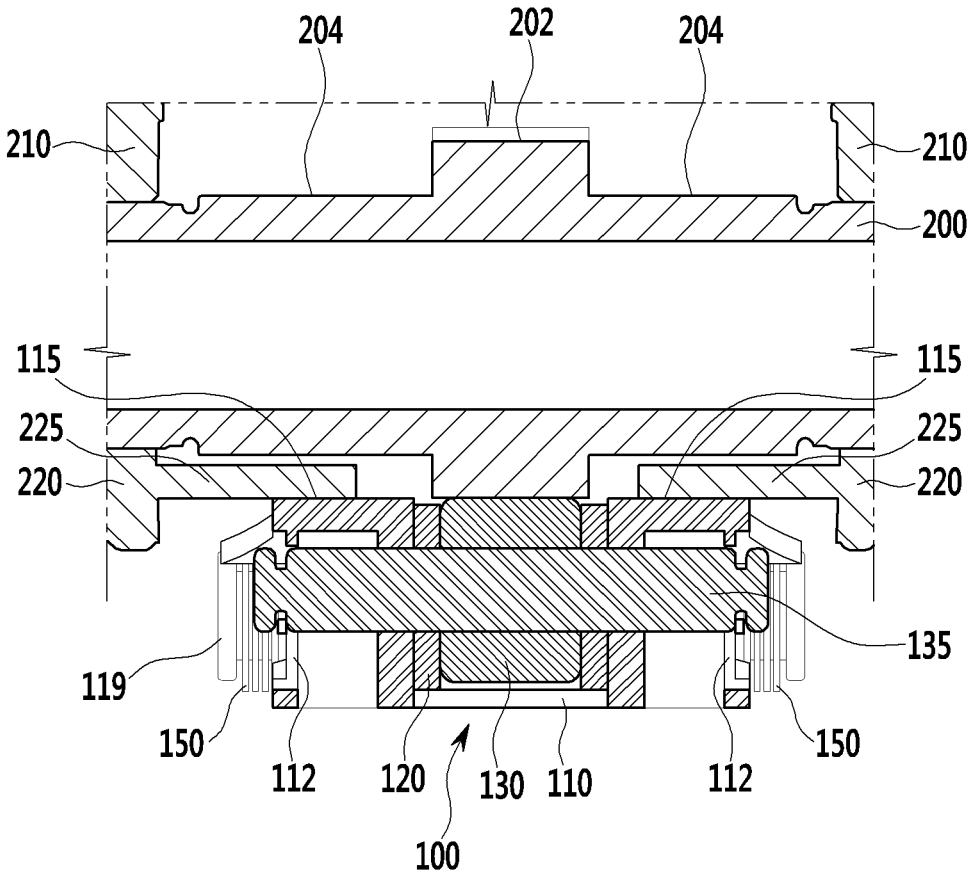
FIG. 3 is a partial cross-sectional view a cylinder deactivation engine according to an exemplary embodiment of the present disclosure.

The roller 130 is disposed in the inside space 124 of the inner body 120. In addition, the roller 130 is rotatably connected with the inner body 120. Meanwhile, a roller rotation shaft 135 is provided so as to rotatably connect the roller 130 with the inner body 120. That is, the roller 130 rotates around the roller rotation shaft 135. Further, the roller 130 is in rolling-contact with the normal cam 202 so as to transform a rotational motion of the camshaft 200 to a lever motion of the outer body 110 or the inner body 120, as best seen in FIGS. 2 and 3.

The connecting shaft 140 is provided so as to rotatably connect the first end 111 of the outer body 110 with the one end of the inner body 120. That is, the inner body 120 is relatively rotated with the outer body 110 around the connecting shaft 140. Herein, portion of the outer body 110 which is connected with the inner body 120 by the connecting shaft 140 will be called "outer connecting portion 114", and portion of the inner body 120 which is connected with the outer body 110 by the connecting shaft 140 will be called "inner connecting portion 122".

A valve contact portion 116 is formed or disposed at the first end 111 of the outer body 110 to be positioned near the outer connecting portion 114. FIG. 1 shows that the outer connecting portions 114 are formed as two spaced apart portions or flanges of the outer body 110, but it is not limited thereto. In case the outer connecting portion 114 is formed as two portions or flanges, the valve contact portions 116 may be formed or disposed as two portions or flanges that are spaced apart and positioned near each of the two outer connecting portions 114. In addition, the two valve contact portions 116 are contacted with the valve so as to push two valves, which are disposed at one cylinder (not shown), depending on the lever motion of the outer body 110.

The inner body 120 is selectively latched to the outer body 110 so as to make a lever motion together with the outer body 110, or is selectively released from the outer body 110 so as to independently make a lever motion.

The lost motion spring 150 functions to return the inner body 120 which makes a rotation relative to the outer body 110 by the independent lever motion in case the inner body 120 latched the outer body 110 is released.

FIG. 2 is a cross sectional side view of a cylinder deactivation apparatus according to an exemplary embodiment of the present disclosure.

As shown in FIG. 2, the inner body 120 further includes a latching pin hole 129, while a latching pin 160, a latching pin stopper 167 and a latching spring 165 are disposed at the outer body 110.

The latching pin hole 129 is a hole to be formed such that a latching pin 160 is inserted thereinto. The latching pin 160 is operated by hydraulic pressure, and may be disposed at the second end 113 side of the outer body 110 so as to easily receive hydraulic pressure. Meanwhile, a member such as a hydraulic lash adjuster (HLA) for supplying hydraulic pressure may be mounted at the second end 113 side of the outer body 110.

The latching pin stopper 167 is provided to prevent that the latching pin 160 is escaped toward the other end direction of the outer body 110.

The latching pin 160 is inserted into the latching pin hole 129 by elastic force of the latching spring 165 such that the inner body 120 may be latched to the outer body 110. That is, the latching spring 165 is a spring which is disposed between the latching pin stopper 167 and the latching pin 160 such that one end of the latching spring 165 pushes the latching pin 160 toward the inner body 120. In addition, a hydraulic pressure chamber 169 which is surrounded by the outer body 110 and the latching pin 160 is formed at the one end side of the latching pin 160. Further, the latching pin 160 is pushed toward the other end direction of the outer body 110 by hydraulic pressure supplied to the hydraulic pressure chamber 169 such that the inner body 120 is released from the outer body 110. In other words, the latching pin 160 is returned by the latching spring 165 so as to be inserted into the latching pin hole 129 such that the inner body 120 is fixed to the outer body 110 in case that hydraulic pressure supplied to the hydraulic pressure chamber 169 is released. Latching and releasing of the outer body 110 and the inner body 120 may be variously realized depending on design change by a person of ordinary skill in the art.

When the inner body 120 is latched to the outer body 110, the inner body 120 and the outer body 110 make a lever motion together around the lever motion pivot shaft 119 of the outer body 110 by rotation of the normal cam 202 in rolling-contact with the roller 130. In addition, when the inner body 120 is released from the outer body 110, only the inner body 120 makes a lever motion around the connecting shaft 140 by rotation of the normal cam 202 in rolling-contact with the roller 130.

Herein, normal lift of the valve may be realized by the outer body 110 which makes a lever motion together with the inner body 120, and zero lift of the valve may be realized as the outer body 110 does not make a lever motion during a lever motion made by only the inner body 120. Thus, the deactivation of the cylinder can be selectively performed.

FIG. 3 is a partial cross-sectional view a cylinder deactivation engine according to an exemplary embodiment of the present disclosure.

A pad portion 115 is formed at the outer body 110 as shown in FIG. 1 to FIG. 3, and the a cylinder deactivation engine according to an exemplary embodiment of the present disclosure includes a pad portion stopper 225 as shown in FIG. 2 to FIG. 3.

The pad portion 115 is a part of an upper portion of the outer body 110 to face the camshaft 200.

The camshaft 200, at which the normal cam 202 is formed or provided, is disposed so as to be not escaped by coupling a cam cap 210 with a cam carrier 220. Herein, the cam cap 210 which surrounds the part of the upper portion of the camshaft 200 and the cam carrier 220 which surrounds a part of a lower portion of the camshaft 200 are well-known to a person of an ordinary skill in the art, so a detailed description thereof will be omitted.

The cam cap 210 and the cam carrier 220 are disposed apart from the normal cam 202 along an axial direction. In addition, a zero cam 204 is formed or disposed between the portions where the cam cap 210 and the cam carrier 220 are coupled, and the normal cam 202 is formed on the camshaft 200. Herein, the zero cam 204 may be an exterior circumference of the camshaft 200.

Conventionally, the zero cam 204 is in rolling-contact with the pad portion 115 of the outer body 110 when zero lift of a valve is performed, but a cylinder deactivation engine according to an exemplary embodiment of the present disclosure inhibits or prevents that the pad portion 115 contacts with the zero cam 204.

The pad portion stopper 225 functions as a stopper blocking the outer body 110 being pushed toward the camshaft 200 by the valve. In addition, the pad portion stopper 225 is integrally formed with the cam carrier 220, and is disposed between the camshaft 200 and the outer body 110. That is, the pad portion stopper 225 is protruded from the cam carrier 220 toward the normal cam 202 along an axial direction, and is protruded to a space between the zero cam 204 and the pad portion 115. Therefore, when zero lift of the valve is performed, the pad portion 115 is contacted to the pad portion stopper 225.

As the pad portion stopper 225 is integrally formed with the cam carrier 220 which does not rotate, abrasion on the pad portion 115 being contacted to the pad portion stopper 225 may be prevented.

According to an exemplary embodiment of the present disclosure, abrasion of the pad portion 115 can be prevented and durability of the cylinder deactivation apparatus 100 can be improved as the pad portion 115 of the cylinder deactivation apparatus 100 is not directly in rolling-contact to the camshaft 200. Further, reliability of cylinder deactivation can be improved as malfunction of the cylinder deactivation apparatus 100 is reduced under the zero lift condition.

This present disclosure is intended to cover various modifications and equivalent arrangements included within the spirit and scope of the appended claims.

What is claimed is:

1. A cylinder deactivation engine selectively performing deactivation of a cylinder having a valve, the cylinder deactivation engine comprising:

a cylinder deactivation apparatus comprising:

an inner body sized and positioned to contact a cam formed on a camshaft and configured to make a lever motion by rotation of the camshaft, and an outer body moving together with the inner body by selectively latching to the inner body so as to open and close the valve; and a stopper integrally formed with a cam carrier surrounding a part of a lower portion of the camshaft and disposed between the camshaft and the outer body so as to block the outer body when the valve pushes the outer body toward the camshaft, wherein the cam carrier is disposed apart from the cam by a predetermined distance along an axial direction, and the stopper is extended from the cam carrier toward the cam along the axial direction.

2. The cylinder deactivation engine according to claim 1, wherein the outer body is configured to make a lever motion together with the inner body by latching to the inner body such that normal lift of the valve is performed, and the outer body does not make a lever motion when released from the inner body such that zero lift of the valve is performed.

3. The cylinder deactivation engine according to claim 2, wherein a part of an upper portion of the outer body facing the camshaft is contacted to the stopper when zero lift of the valve is performed.

4. A cylinder deactivation engine selectively deactivating at least one of cylinders thereof via a camshaft having a cam, the cylinder deactivation engine comprising:

a cylinder deactivation apparatus comprising:

an inner body positioned to contact the cam and configured to perform a lever motion by rotation of the camshaft; and an outer body selectively rotatably connected with the inner body by a connecting shaft and configured to deactivate said at least one cylinder when the outer body is latched to the inner body for movement therewith by a latch; and a cam carrier surrounding a portion of the camshaft and disposed between the camshaft and the outer body, the cam carrier having a stopper which is extended from the cam carrier toward the cam along an axial direction of the camshaft, and sized and positioned to block the outer body when the outer body is moved toward the camshaft.

5. The cylinder deactivation engine according to claim 4, wherein the latch comprises a latching pin hole formed in the inner body, and a latching pin and a latching spring disposed in the outer body, wherein the latching pin is configured to insert into the latching pin hole so as to selectively latch the outer body to the inner body.

6. The cylinder deactivation engine according to claim 5, wherein the latching spring is configured to push the latching pin into the latching pin hole when a pressure of a pressure chamber formed in the outer body is released such that the inner body is fixedly connected to the outer body and moves together.

* * * * *